United States Patent [19]

Vanderklaauw

[11] Patent Number: 4,832,315

[45] Date of Patent: May 23, 1989

[54] SYSTEM FOR SYNCHRONIZED LIFTING OF HEAVY BUILDING ELEMENTS

[76] Inventor: Peter M. Vanderklaauw, P.O. Box 430253, Miami, Fla. 33243-2053

[21] Appl. No.: 166,951

[22] Filed: Mar. 1, 1988

[51] Int. Cl.[4] ..... E04G 21/14

[52] U.S. Cl. ..... 254/89 H; 52/745; 52/126.1

[58] Field of Search ..... 52/126.1, 745; 254/89 H, 89 R

[56] References Cited

U.S. PATENT DOCUMENTS

| | | | |
|---|---|---|---|
| 2,975,560 | 3/1961 | Leonard | 254/89 H |
| 3,036,816 | 5/1962 | Stubbs et al. | 254/89 H |
| 3,396,944 | 8/1968 | Jansz | 254/89 H |
| 4,251,974 | 2/1981 | Vanderklaauw | 254/89 H |

*Primary Examiner*—Robert C. Watson
*Attorney, Agent, or Firm*—John Cyril Malloy

[57] ABSTRACT

A construction system incorporating the formation of a plurality of building components, such as but not limited to concrete slabs used for floors, wherein the slabs are formed about a plurality of supporting columns of a predetermined height depending upon the intended height of the building under construction. The subject system includes a plurality of lifting assemblies secured to the slabs, and structured to travel along the length of the columns carrying the slabs as they travel. A control assembly is provided to insure a level orientation of the slabs and a consistent rate of travel and lifting force being exerted on the slabs uniformly so as to maintain such slabs, during lifting, in a level orientation to prevent damage thereto.

10 Claims, 6 Drawing Sheets

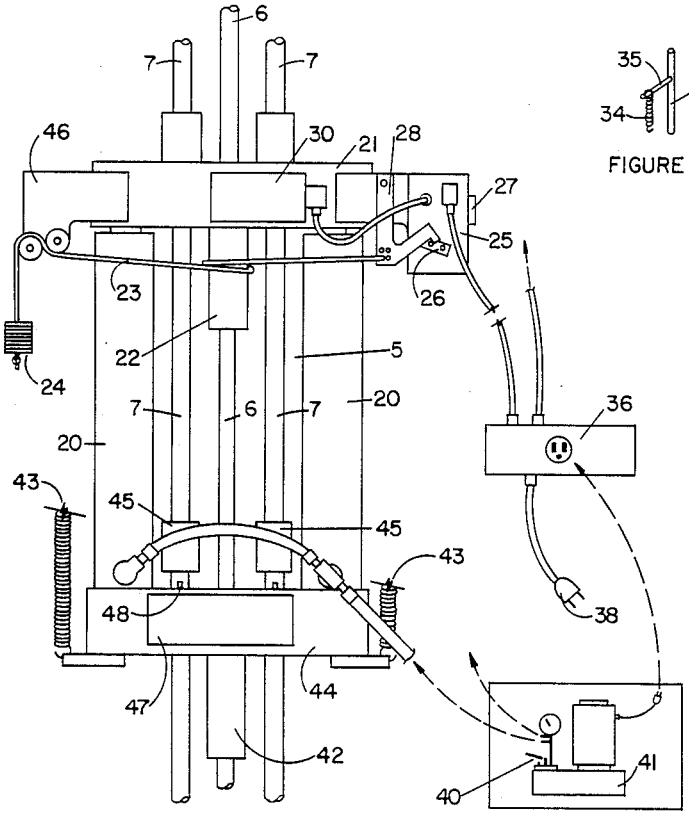
FIGURE 6
FIGURE 7
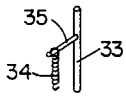
FIGURE 9
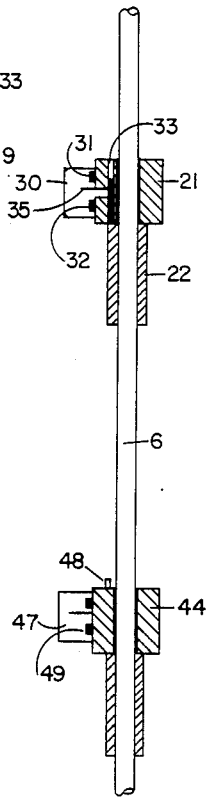
FIGURE 8
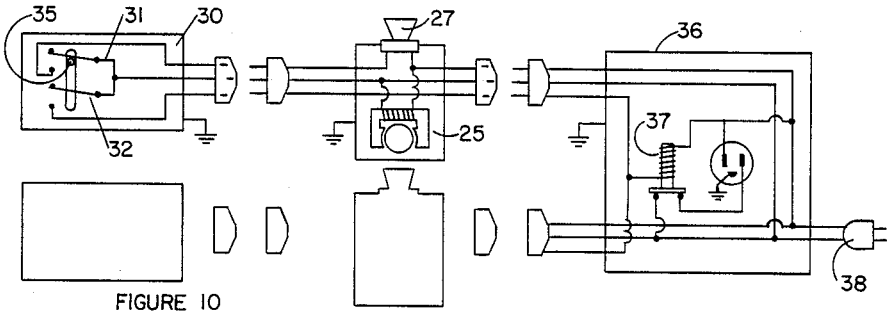
FIGURE 10

SYSTEM FOR SYNCHRONIZED LIFTING OF HEAVY BUILDING ELEMENTS

REFERENCE TO RELATED APPLICATIONS

Related subject matter is disclosed and claimed in my copending applications Ser. No. 948,168, filed Oct. 3, 1978 now U.S. Pat. No. 4,206,162 and Ser. No. 33,053, filed Apr. 25, 1979 now U.S. Pat. No. 4,251,974.

BACKGROUND OF THE INVENTION

Lifting structural parts of buildings such as concrete floors has been done for many years and there are many ways in which such lifting is accomplished.

Most systems have hydraulic jacks to provide the lifting force and wedges or screws following the movement upward to insure continuous mechanical support. These systems are powerful and simple. This invention belongs in this category of lifting systems.

In a typical construction project utilizing this type of system there are usually a number of columns on which jacks are mounted. A serious problem in lifting large, heavy structures, especially concrete floor slabs and like structures, is that all lifting points must rise at exactly the same rate otherwise those structures become subjected to internal stresses and possible cracking or total failure.

Controlling the movement of lifting points in prior art has been done by simply placing a transit or builder's level in a strategic location from which incremental movement is observed. The observer controls the jacks by snubbing hydraulic valves that are placed within his reach. Another means of controlling movement is by having a special hydraulic pump deliver the same amount of oil to the jacks at each lifting point.

Both of these control methods are used extensively in the house raising and house moving business. They have also been used in liftslab construction, but in some cases with disastrous result because of inaccuracy in synchronization. A method now widely and successfully used in liftslab construction is a method patented by Marshall Long under U.S. Pat. No. 3,201,088. It has hydraulic jacks providing the lifting force. The oil feeding the jacks also feeds small cylinders which turn checknuts at each jacking point. Lifting is controlled in a manner that prevents the beginning of any new lifting cycle unless checknuts at all the lifting points have completed an incremental turn. The Long method is accurate and dependable. However, it has three distinct disadvantages: one is that the equipment is complex and expensive and consequently only economical in large projects. Another is that it has a power unit supplying oil to 20 to 30 jacks from one central location. A breakdown in the power unit shuts down the entire lifting operation. A third disadvantage is that the lifting units are placed on tops of columns. In multistory buildings this means that every time two stories have been lifted the equipment has to be removed to allow columns to be extended. Staging is time consuming and expensive. This invention seeks to eliminate these disadvantages.

SUMMARY OF THE INVENTION

This invention is designed for the lifting of heavy building elements, such as concrete slabs, in a manner which is less expensive, more reliable and faster in its operation than known prior art methods. To make lifting less expensive the system is composed largely of parts readily available on the open market. To make lifting more reliable the system is modularized, each lifting point has self-contained lifting units of which each operating part can be removed and replaced in just a few minutes. To lift at a faster rate, the lifting equipment is mounted on the sides of columns. Side mounting permits column sections to be constructed with a height of up to six stories. This height in many cases is full length and therefore no field splices causing serious interruption in the lifting operation is required.

An important feature of this system is that it has external sensing and control apparatus which allows continued lifting without making adjustments for differential column loads. Part of this invention is a new shearhead design. Whereas in existing systems lifting rods attach directly to the shearhead, the subject invention has reusable hook-up plates. Another part of this invention is a simple jacking arrangement for single slab lifts.

BRIEF DESCRIPTION OF THE DRAWINGS

FIG. 6 is a frontal view of a lifting unit showing hydraulic cylinders, gap sensors and nut drive.

FIG. 7 is a diagram of an electric hydraulic pump.

FIG. 8 is a section through the center of the lifting unit of FIG. 6, specifically showing a probe which monitors the gap between the top crosshead and the checknut.

FIG. 9 is an isometric view of the probe shown in FIG. 8.

FIG. 10 is an electrical circuit diagram of the lifting control apparatus.

DETAILED DESCRIPTION OF THE PREFERRED EMBODIMENT

Figure 1:
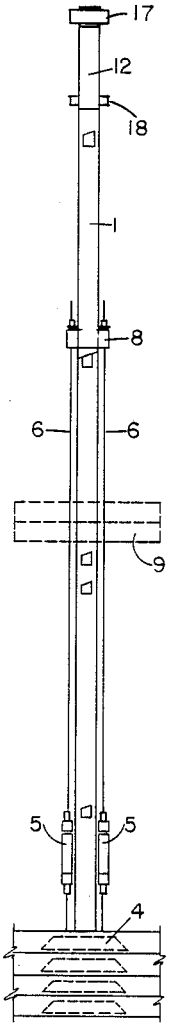
FIG. 1 is an elevation of a building column showing lifting equipment attached to the sides of the column, and concrete floors ready to be lifted.
Figure 2:
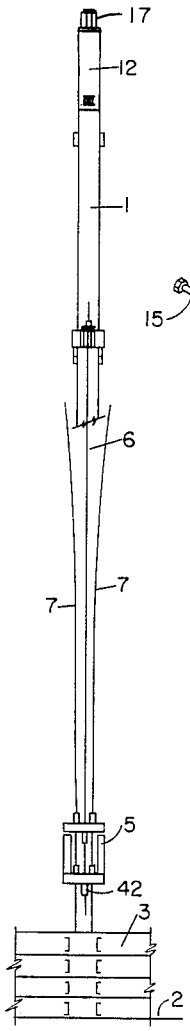
FIG. 2 is a side view of the column of FIG. 1. The column is partially shown for clarity.

With reference to FIGS. 1 and 2 and describing the lifting system in more detail, the building process starts by erecting steel or concrete columns 1 on isolated foundation footings. For purposes of clarity, footings are not shown. A ground slab 2 is then placed and concrete floor plates 3 are formed in a stacked relation one on top of the other. Embedded in the floor plates 3 are shearheads 4 which attach the lifting equipment 5 to the floor plates 3.

To prepare for lifting, each column 1 is fitted with two lifting units 5, disposed on opposite sides and pendantly attached to the column 1 by means of suspender rods 6. Floor plates are attached to the lifting equipment by means of pull rods 7. The lifting equipment 5 is designed in a way that it can climb up the suspender rods 6. Suspender rods and pull rods are externally threaded.

Figure 5:
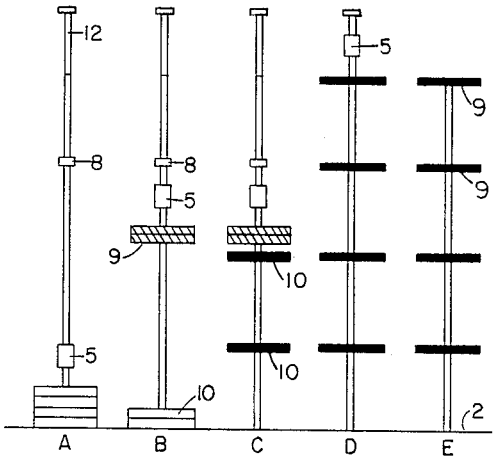
FIG. 5 is a diagram showing progressive steps in the construction of a building frame.

Now referring to FIG. 5, in diagram A the equipment is ready to start the lifting process in which two floor plates 9 are lifted together and temporarily positioned above the second floor level B. At this point pull rods 7 (not shown in FIG. 5) are lowered and attached to the next two concrete floor plates 10 to prepare for the second lift. After the lifting equipment is changed from climbing mode to pulling mode, the lower two plates 10 are pulled into permanent position C where they are welded to the columns.

To start the final lifting phase, hook-up collar 8, with suspender rods 7 mounted, is raised to the top of the column extender 12. The lifting equipment is converted back to climbing mode and floors are lifted in similar manner as shown in diagram A except that floors are dropped off in their permanent position on the way up (see diagram D). In diagram E the lifting equipment is removed.

Figure 3:
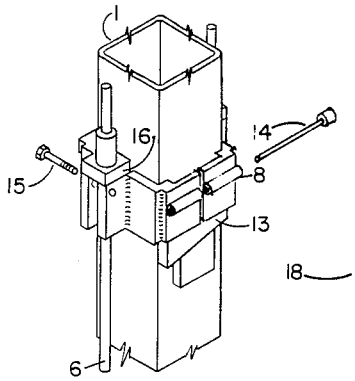
FIG. 3 is a hook-up collar designed to attach lifting equipment partway up to the column.
Figure 4:
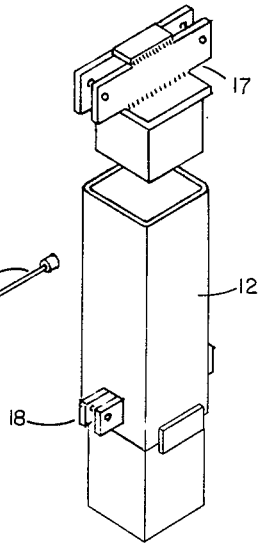
FIG. 4 is a column extender designed to attach lifting equipment a predetermined height above roof level.

With reference to FIGS. 3 and 4, the hook-up collar 8 rests on wedges 13 which are later used in the final building frame. A separate weld plate may also be used to support the hook-up collar. Bolt 15 prevents the suspender rod 6 from falling out. Bolts 14 serve to hold the two halves of the hook-up collar together. Two through bars 18 stabilize suspender rods 6 until the lifting equipment arrives at that location at which time they are removed.

FIG. 6 discloses a lifting unit 5 with two hydraulic cylinders 20 which, when activated, force the upper cross-head 21 upward. Since the floor plates 3 are attached to the upper crosshead 21 by pull rods 7, the floor plates also rise. As upper crosshead 21 rises a checknut 22 mounted to travel along the exterior threaded surface of suspender rod 6, follows the crosshead 21 immediately therebeneath and in engagement therewith to prevent fall-back in case of hydraulic failure. The checknut 22 is driven by a cord 23 wrapped around the exterior surface thereof which has a weight 24 secured to one end and further attached at its opposite end to a rocker arm 28. An electric motor 25 rotates two pins 26 in a clockwise directions. The rotating pins 26 cause the rocker arm 28 and consequently the cord to move slowly from left to right and allows it to jump back quickly. This motion causes checknut 22 to turn. If for any reason a small gap develops between the checknut 22 and the upper crosshead an alarm 27 starts to sound which would call for the operator to turn the checknut 22 by hand. If the gap continues to increase beyond $\frac{3}{8}$ inch the pump of FIG. 7 shuts off. A cam wheel or other applicable structure may take the place of cord 23. As further disclosed in FIGS. 9 and 10, box 30 contains two limit switches 31 and 32 activated by a probe 33 which is forced upon the top of the checknut 22 by means of a spring 34 (see FIG. 9). The horizontal part of the probe 35 reaches into box 30.

With reference to FIG. 10, a box 36 contains a relay 37. The relay stops the pump when the gap between checknut 22 and upper crosshead 21 increases beyond $\frac{3}{8}$ inch. The pump starts again when the operator turns the checknut 22 up by hand. Power source for the equipment comes through plug 38 and FIG. 10 discloses the above set forth safety switching circuit diagrams.

When a stroke of the hydraulic cylinders 20 is complete, an operator manually opens the valve 40 on the hydraulic pump in FIG. 7, allowing the oil to return to the pump reservoir 41. The lower crosshead 44 is forced up by springs 43 mounted between the lower crosshead 44 and the upper crosshead 21. As soon as the cylinders are returned, the operator turns up nut 42 and closes valve 40 to start a new cycle. The last two motions can be done automatically if more speed is desired.

Described above is the climbing mode to accomplish placement of the lifting unit 5 between the positions shown in FIGS. 5A and 5B. In order to convert to pulling mode, nuts 45 become checknuts and drive motor 25 is now mounted to the left side of the lower crosshead 44 while pulley plate 46 is mounted to the right-hand side. In this mode probes 48 operate on limit switches 49 in box 47. In the climbing mode nuts 45 are inactive, in the pulling mode nut 22 is inactive.

Figure 11:
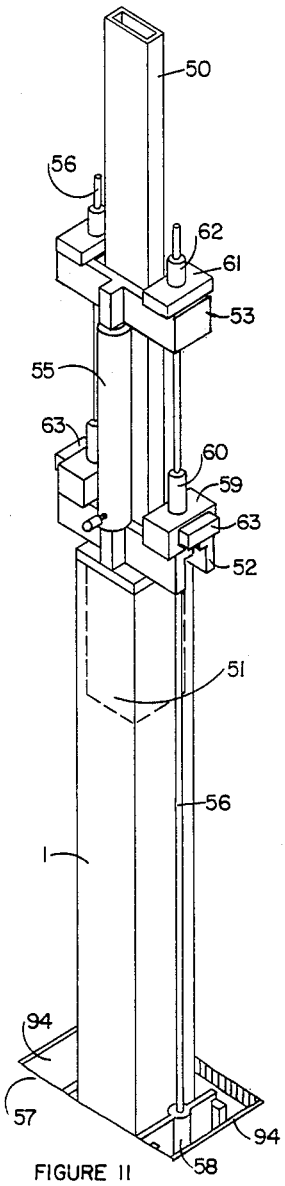
FIG. 11 is an arrangement of jacks and crossheads used in single story buildings.
Figure 11A:
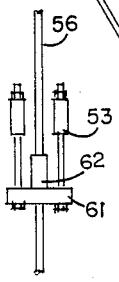
FIG. 11A is a partial view of an alternate structure to attach the pull rod to the crosshead of FIG. 11.
Figure 16:
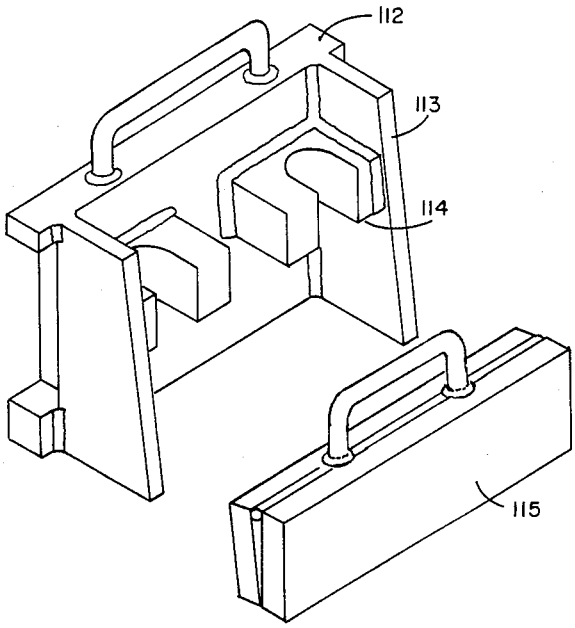
FIG. 16 is a hook-up plate with securing wedge designed to connect pull rods to the shearhead.

Now referring to FIG. 11, when a single floor plate is lifted the equipment may be simplified by using a lifting pole 50. The lifting pole consists of a plug 51 fitting inside the columns 1, a fixed crosshead 52 and a sliding crosshead 53. Between the crossheads there are two hydraulic cylinders 55. Two pull rods 56 attach to the concrete plate 57 using single hitches 58 or hook-up pltes shown in FIG. 16. Bearing plates 61 rest on the sliding crosshead 53 as shown in FIG. 11A. Not shown, for purposes of clarity, are two nut drive motors which drive checknuts 60. Bearing block 59 is fitted with a gap sensor 63. The lifting action is quite clear. When the hydraulic cylinders 55 extend, the floor plate 57 rises. To ensure continuous mechanical contact, checknuts 60 turn down. As in the multi-story system an alarm sounds when a gap between checknut 60 and bearing block 59 develops. The hydraulic pump shuts off when the gap grows beyond $\frac{3}{8}$ inch. At the end of a stroke the oil is drained out of the cylinders and nuts 62 are turned down to start a new cycle. The lifting pole 50 can be adapted to H-columns or other type of columns. Column extenders 12 (FIG. 4) also can be adapted to H-columns.

Figure 12:
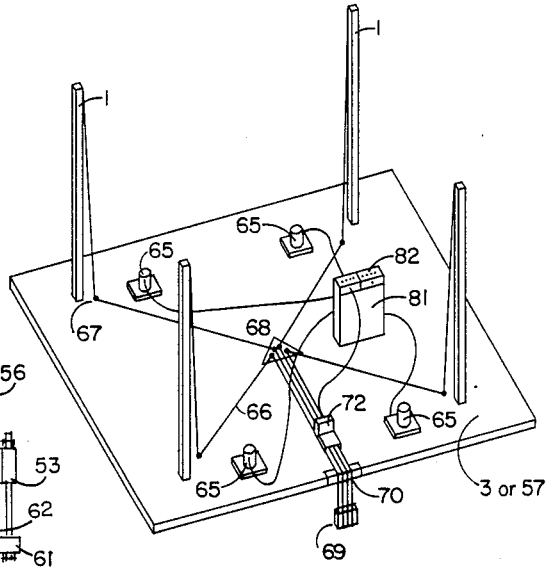
FIG. 12 is an isometric view in schematic form of tapes and sensors used to synchronize lifting points.
Figure 13:
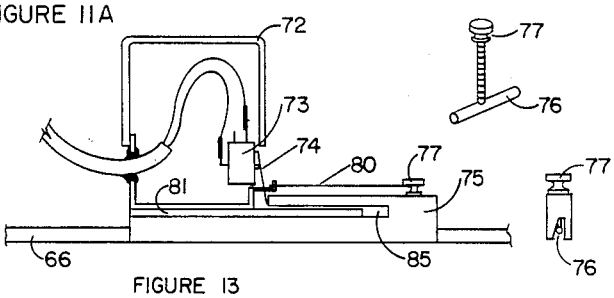
FIG. 13 is a cross-section through the tape sensing device.
Figure 14:
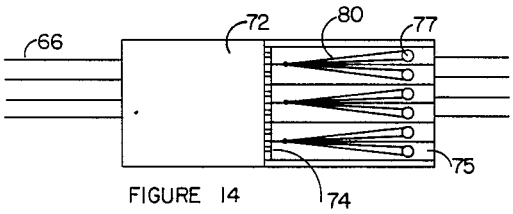
FIG. 14 is a top view of the tape sensing device.

Now referring to FIG. 12, this is a diagram showing the manner in which the various lifting points are synchronized. Tapes 66 are formed from a metal or other applicable material and are attached to the tops of the columns 1. The tapes are laced through pulleys 67 at the base of the columns. The pulleys are attached to the floor plate 3 to be lifted. The tapes, only four are shown but there may be as many as thirty, converge in the center of the floor where they are laced through pulley block 68 and directed towards pulley strip 70 at the edge of the floor and fitted with weights 69. One weight to each tape. When the floor plate moves upward in relation to the columns the tapes move across the floor. Where the tapes run parallel, a sensor 72 is placed over them. The tape sensor is shown in more detail in FIGS. 13 and 14. The sensor 72 contains micro switches 73, each operated by a lever 74. A sensor key 75 is attached to each tape by means of a round bar 76 in a tapered slot in the bottom of the key. The round bar 76 has a thumb screw 77 which serves to tighten the round bar 76 into the tapered slot thus clamping the key 75 to the tape 66.

Between sensor body 72 and each thumb screw 77 there is an elastic band 80 or spring. The sensor body has a bottom plate 81. The keys have horizontal slots 85 allowing the keys to slidingly fit the bottom plate 81. When all the tapes move at the same rate there is synchronous lifting and micro switches 73 engage. However, as soon as one tape advances faster than others the associated micro switch switches off. This causes the pump 65 related to that switch to stop until the other pumps have caught up. It is clear that the lifting progresses as fast as the slowest pump. Instead of lever switches, photo electric switches or other means of sensing may be used. It is also possible to use wire instead of tape.

Power supply is through breaker panel 81 to switch board 82. Toggle switches on the switch board allow the operator to turn the entire system off and on and also override the sensors 72.

Figure 15:
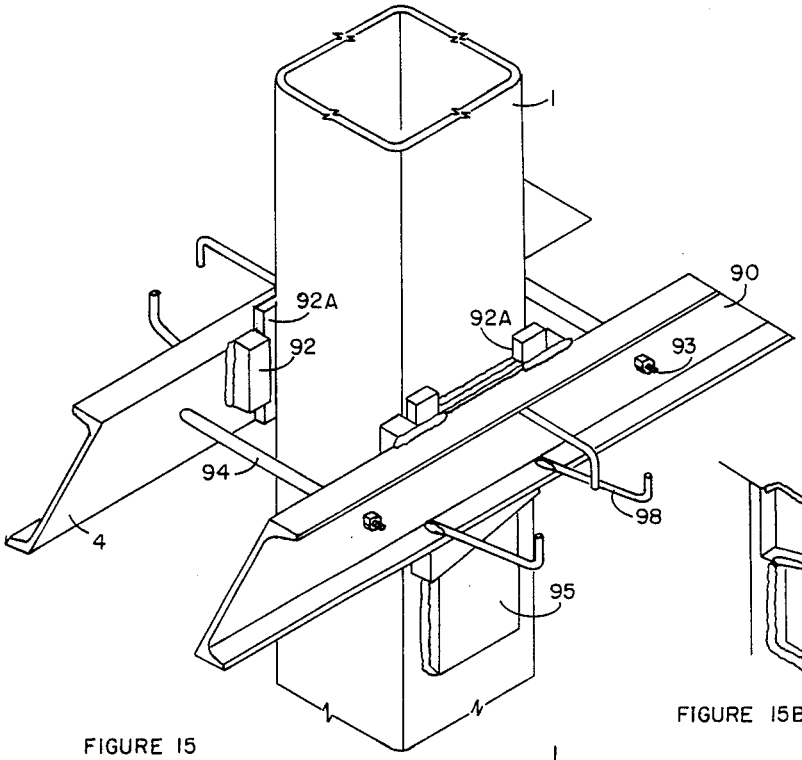
FIG. 15 is a typical shearhead used with a concrete slab.
Figure 15B:
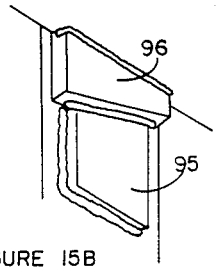
FIG. 15B is an isometric view of a wedge supporting the shearhead.
Figure 15A:
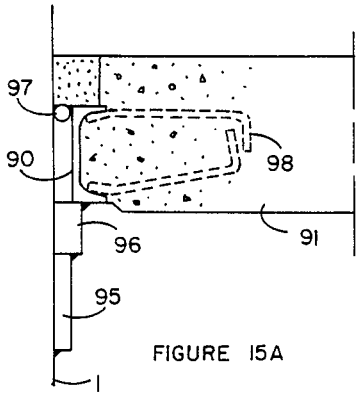
FIG. 15A is a sectional view in partial cutaway showing a concrete slab being secured to the column of FIG. 15.
Figure 17:
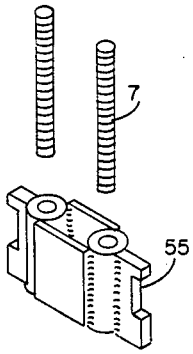
FIG. 17 is a double hitch designed to connect two pull rods to the shearhead.
Figure 17A:
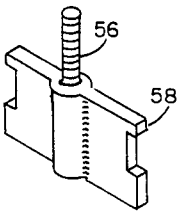
FIG. 17A is a single hitch designed to connect one pull rod to the shearhead.
Figure 18:
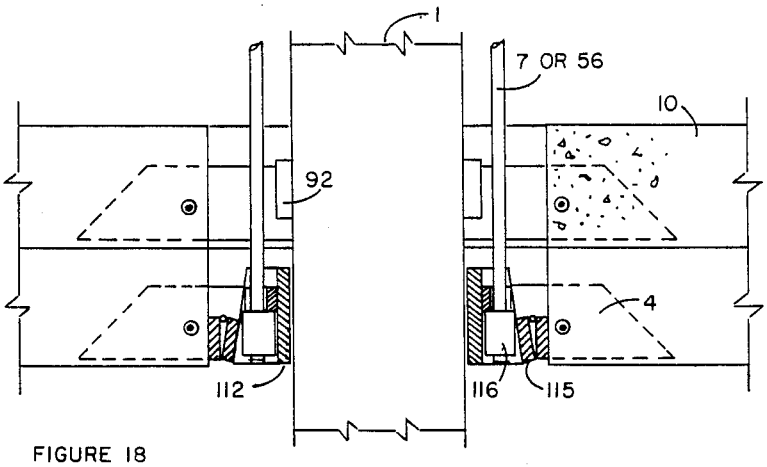
FIG. 18 is a sectional view of the hook-up plate of FIG. 16 connecting to a shearhead as it is embedded in concrete being lifted.

Referring now to FIG. 15, it shows a shearhead 4 comprising two steel channels 90 welded to a column 1. The channels 90 are embedded in the concrete 91 as shown schematically in FIGS. 1 and 2 and in detail in FIG. 15A. FIGS. 11 and 18 also show the shearhead embedded in concrete. A distinct feature of this shearhead is that it has four hook blocks 92 welded to the channels 90. These hook blocks 92, welded adjacent to guide bars 92A facilitate pull rods 7 and 56 being hooked to the shearhead 4 using hook-up plates shown in FIGS. 16 and 18 or hitches shown in FIGS. 17 and 18. A hook-up plate is a welded assembly comprising a backplate 112, two tapered wingplates 113 and one or two slotted plates 114. There is also a wedge bar 115. The function of the hook-up plate and wedge bar is to facilitate attachment of pull rod 56 or rods 7 to the shearhead 4 as clearly shown in FIG. 18. The pull rod has an internally threaded cylinder 116 at its end which hooks under the slotted plate 114 and locked in place by wedge bar 115. Shearhead 4 is field assembled using two bolts 93 and spacer 94 disposed in spaced relation between channels 90. A pocket or aperture is spared out of the concrete to facilitate hook-up plates to be installed as clearly shown in FIG. 18. The pocket or aperture is filled with concrete after lifting is completed. FIGS. 15 and 15A further show seal bars 97 which facilitate welding the top of the shearhead 4 to the column 1 when lifting and positioning of slabs 10 are complete, and wedges 96 which are inserted on top of weld plate 95 when the floor or slab 10 or 57 reaches the proper elevation. Anchors 98 ensure proper embedment into the concrete.

The channels 90 in FIGS. 15 and 15A may be replaced by I-beams if a stronger configuration is required. A two-way closed shearhead may also be constructed by welding channels or I-beams at 90 angles to the shearhead of FIG. 15 using welded channels instead of bolts and spacers.

Figure 19:
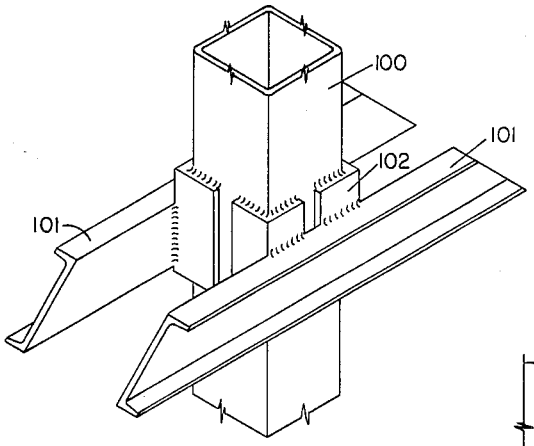
FIG. 19 is an alternate shearhead designed primarily used in one and two slab frames.
Figure 20:
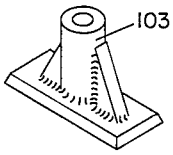
FIG. 20 is a hook-up nut used in the shearhead of FIG. 19.
Figure 21:
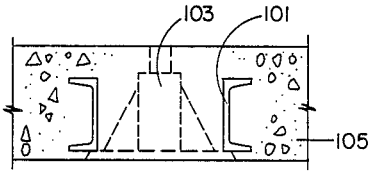
FIG. 21 is a sectional view of the shearhead of FIG. 19 secured within a concrete slab being lifted.

FIG. 19 is another embodiment of an alternate shearhead design. This design is very simple and can be used in one and two-slab frames. This embodiment is structured so that welding to the column 100 has to be done before the lifting equipment can be removed or further lifting can take place. This shearhead features four steel angles 102 welded to two channels 101 disposed in parallel relation to one another. When lifted in place the angles 102 are permanently welded to column 100. To enable the lifting equipment to hook onto the shearhead two hook-up nuts 103 (FIGS. 20 & 21) are cast in the concrete 105, one on each side of the column 100. When the slab is welded in position, the hook-up nuts 103 are removed by inserting a short rod and hammering them down. The hook-up nuts 103 may have a single internally threaded cylinder as shown or two internally threaded cylinders. The hook-up nuts 103 can be reused.

Figure 22:
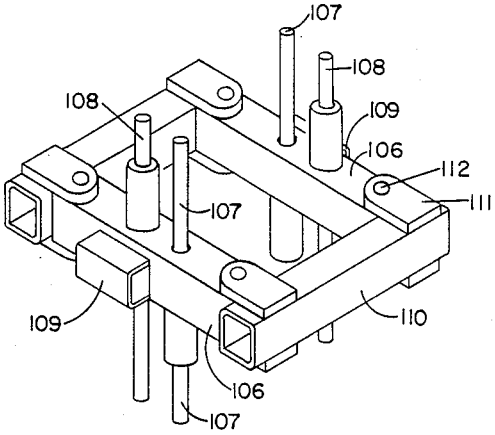
FIG. 22 is an alternate arrangement of crossheads wherein four rods per column are used instead of six as in FIG. 6.
Figure 23:
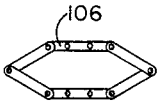
FIG. 23 is an alternate to the torsion bars used in FIG. 22.

Referring now to FIG. 22, it shows an alternate arrangement of crossheads 106 with gap sensors 109. In this arrangement there are two suspender rods 107 and two pull rods 108. The two crossheads 106, when loaded, would tend to rotate in opposite direction. To stop the rotation two torsion bars 110 are attached to the ends of crossheads 106. The lifting action, using this alternate arrangement, is the same as described for the embodiment of FIG. 6. Instead of straight torsion bars 110 a scissor configuration can be used as shown in FIG. 23.

Features of shearheads of FIGS. 15 and 19, may be interchanged to suit specific conditions.

What is claimed is:

1. A construction system of the type primarily designed to lift building components, including one or more concrete slabs about a plurality of columns and in a substantially level orientation, from a ground level, to a designated height dependent upon the height of the building being constructed, said system comprising:

(a) a plurality of lifting assemblies each movably secured to one of a plurality of upstanding columns and including a crosshead construction structured to travel along the length thereof, (b) each of said lifting assemblies including a suspension means for lifting said crosshead construction along the length of said column and having an elongated configuration and being secured at substantially one end thereof to any upper portion of said one column at a height greater than said designated height to which said slab is to be lifted, said suspension means movably secured to said crosshead construction and cooperatively structured therewith for movable engagement of said crosshead construction along the length of said suspension means towards said upper portion of said column, (c) each of said lifting assemblies further including pulling means for lifting the slab and mounted to extend along a length of said one column, said pulling means movably connected to said crosshead construction and to the slab being lifted, said pulling means structured to provide movement of both the slab and said crosshead construction along the length thereof, (d) said crosshead construction including an upper crosshead and a lower crosshead; a first and a second drive assembly interconnected in driving relation between said crossheads, said drive assemblies cooperatively structured to cause sequential advancement of said crossheads and the connected slab along the length of said column, (e) a shearhead structure interconnecting the slab to said pulling means and being fixedly secured to the slab being lifted and movably attached to said pulling means so as to travel along the length of said column, (f) control means for regulating the rate of travel of said lifting assemblies along said respective columns and including a plurality of sensor elements each connected in a fixed position on one of said columns and collectively disposed to extend therefrom into communicating relation with a scanner assembly, (g) said scanner assembly mounted on the slab being lifted so as to travel therewith, and said plurality of sensor elements caused to travel relative to said scanner assembly upon lifting movement being imparted to the slab, and said control means interconnected to said drive assemblies and structured to stop actuation thereof upon a variance in the rate of travel of said sensor elements relative to one another passed said scanned assembly.

2. A system as in claim 1 wherein said first drive assembly is interconnected between said upper and said lower crossheads and structured to cause forced separation of one from a fixed position of the other, said second drive assembly structured for biased interconnection between said crossheads and disposed to force the fixedly positioned crosshead towards said separated crosshead upon deactivation of said first drive assembly.

3. A system as in claim 2 wherein said first drive assembly comprises a hydraulically powered piston and cylinder assembly disposed and structured to cause separation between said upper and lower crossheads upon activation thereof.

4. A system as in claim 3 wherein said second drive assembly comprises a spring assembly interconnected to both said upper and lower crossheads and disposed and structured to bias said crossheads into a non-separated position upon deactivation of said first drive assembly.

5. A system as in claim 1 wherein said suspension means comprises an externally threaded rod extending substantially along the length of said column from a ground level to a height greater than the designated height to which the slab to be lifted is positioned, said suspension rod threadedly interconnected to each of said upper and lower crossheads, said lift assemblies interconnected to said upper and lower crossheads to cause sequential travel of said crosshead along the length of said suspension rod upon activation of said drive assemblies.

6. A system as in claim 5 wherein said pulling means comprises at least two externally threaded elongated rods extending along the length of said column from a ground level to a height greater than said designated height at which the slab being lifted is placed, said pulling rod disposed in spaced apart and parallel relation to said suspension rod and being threadedly interconnected to said upper and lower crossheads, the slab interconnected to said pulling rods by a threaded interconnection therebetween, said threaded interconnection disposed and structured to travel along the length of said pulling rods upon activation of said drive assemblies.

7. A system as in claim 6 further comprising a shearhead construction fixedly secured to said slab and interconnected to said pulling rod by said threaded interconnection, said shearheads fixedly secured to the exterior surface of said column when said designated height of placement of the slab is reached.

8. A system as in claim 5 wherein each of said lift assemblies includes a follower stop structure structured to threadedly engage said suspension rod in immediately abutable position relative to one side of each of said upper and lower crossheads, said one side of said respective crossheads defined by a side disposed opposite to the direction of travel of said lift assembly; follower drive means being independently powered from said lift assembly and connected in driving engagement with said follower stop means such that said follower stop means respectively travel along the length of said suspension rod along with said lift assembly and in abutting engagement therewith, whereby fixed position of said lift assembly relative to said suspension rod is maintained upon failure of said drive assemblies.

9. A system as in claim 1 wherein said sensor element each comprise an elongated flexible material tape having one end secured to an upper portion of a column and extending downwardly along the length thereof to the slab being lifted, each of said sensor tapes extending from said column along the slab to said scanning assembly in communicating relation therewith, anchor means attached to each of said sensor tapes substantially adjacent an opposite end thereof relative to said column and structured for maintenance of said plurality of sensor tapes in substantially fixed position, relative to said column during an upward lifting of the slab, the slab movable relative to the positioning of said sensor tapes in communicating relation with said scanner assembly, the relative movement of each sensor tape being dependent upon the rate of travel of a respective lift assembly relative to said respective column.

10. A system as in claim 9 wherein said scanner assembly is structured to determine rate of movement between each of said sensor tapes relative to the slab being lifted, said sensor structure interconnected to said drive assemblies of said respective lift assemblies so as to regulate activation thereof upon determination of said respective sensor tapes moving at a rate faster than the remaining sensor tapes relative to the lifting of the slab.

* * * * *